US006445896B1

(12) United States Patent
Satoh

(10) Patent No.: US 6,445,896 B1
(45) Date of Patent: Sep. 3, 2002

(54) IMAGE FORMING APPARATUS INCLUDING A CHARGING DEVICE THAT CONTACTS A PORTION OF AN IMAGE CARRIER BELT SPANNING A DRIVING ROLLER AND METHOD OF USE

(75) Inventor: Toshiya Satoh, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 09/803,143

(22) Filed: Mar. 12, 2001

(30) Foreign Application Priority Data

Mar. 10, 2000 (JP) ..... 2000-066136
Feb. 9, 2001 (JP) ..... 2001-034667

(51) Int. Cl.[7] ..... G03G 15/02
(52) U.S. Cl. ..... 399/174; 399/162; 399/174
(58) Field of Search ..... 399/162, 167, 399/164, 165, 163, 174, 176, 175, 349, 350, 351, 353, 354, 357; 361/212, 221, 222, 225, 230

(56) References Cited

U.S. PATENT DOCUMENTS 5,146,280 A * 9/1992 Kisu ..... 399/176
5,291,251 A * 3/1994 Storlie et al.
5,459,558 A * 10/1995 Ishiyama ..... 399/176
5,845,177 A * 12/1998 Choi ..... 399/176
5,873,019 A * 2/1999 Mizuishi ..... 399/176
5,875,380 A 2/1999 Iwata et al.
6,006,057 A * 12/1999 Snelling ..... 399/162
6,035,154 A * 3/2000 Takahata et al.

FOREIGN PATENT DOCUMENTS

JP 5-289426 11/1993
JP 9-281847 10/1997

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus includes an endless image carrier belt configured to be spanned around a driving roller and a driven roller and moved by a friction force provided from an outer circumference surface of the driving roller when the driving roller is rotated, a charging device configured to contact an outer surface of the image carrier belt to charge the image carrier belt. The outer surface of the image carrier belt which the charging device contacts is a portion of the image carrier belt contacting the driving roller.

12 Claims, 11 Drawing Sheets

IMAGE FORMING APPARATUS INCLUDING A CHARGING DEVICE THAT CONTACTS A PORTION OF AN IMAGE CARRIER BELT SPANNING A DRIVING ROLLER AND METHOD OF USE

BACKGROUND OF THE INVENTION

1. Field of the Invention

The present invention relates to an image forming method and apparatus in which an image carrier belt is driven and moved only by a friction force from a driving roller and the image carrier belt can be driven and moved stably.

2. Discussion of the Background

Image forming apparatuses such as a copying machine, a printer, a facsimile machine or a multi-function machine having at least two of a copying machine, printer and facsimile machine functions, have been known. The form of an endless image carrier belt used in the image forming apparatuses can be set somewhat freely as compared to an image carrier drum, and therefore devices such as a charging member, etc., arranged around the image carrier belt can be arranged relatively freely. Further, because the charging member contacts the image carrier belt to charge the image carrier belt, the generated amount of ozone can be decreased as compared to a corona discharging device having a charging wire which is arranged far apart from the image carrier belt. As a concrete structure of an image forming apparatus using the image carrier belt, there is one including an endless image carrier belt which is spanned around a driving roller and a driven roller, and which is moved and driven by a friction force from an outer circumference surface of the rotating driving roller, and a charging member to charge the image carrier belt by contacting the outer surface of the image carrier belt, and in which an electrostatic latent image is formed on the image carrier belt charged by the charging member, and the electrostatic latent image is visualized as a toner image, and further the image toner is transferred directly or via an intermediate transferring member onto a recording medium. As the charging member, for example, a charging roller, a charging blade or a charging brush, etc., which contacts an outer surface of the image carrier belt at least at a part thereof, can be adopted.

Because all of the charging members described above contact the outer surface of the image carrier belt, when the image carrier belt moves the friction force between the image carrier belt and the charging member provides a braking force on the image carrier belt. On the other hand, the image carrier belt is driven and moved by the friction force from the outer circumference surface of the driving roller, and therefore when the braking force described above is provided on the image carrier belt, the image carrier belt easily slips with respect to the driving roller. If the slip amount is large, the moving stability of the image carrier belt is reduced, and the linear speed of the belt surface changes, causing unevenness in the belt moving speed. If the unevenness occurs in the image carrier belt moving speed, density unevenness occurs in a toner image transferred onto a recording medium. Further, in an image forming apparatus in which toner images of different colors are formed on the image carrier belt in sequence, transferred onto an intermediate transferring member one after another while superimposing one upon the other, and the superimposed toner images are transferred onto a recording medium all together, the unevenness in the belt moving speed described above causes color dislocation in the color toner image transferred onto the recording medium, thereby reducing the image quality.

If holes are formed in a side edge portion of the image carrier belt over its entire length at equal intervals, and pins formed in a driving roller over its entire circumference at equal intervals and are engaged with the holes, the image carrier belt can be forcefully driven by the pins when the image carrier belt is driven and moved by the rotation of the driving roller. Therefore, in this case, even when the charging member contacts the outer surface of the image carrier belt, slip of the image carrier belt with respect to the driving roller can be effectively reduced, and thereby density unevenness or color dislocation of a toner image can be prevented from occurring. However, if a driving roller having many pins and an image carrier belt likewise having many holes are used, the structure of an image forming apparatus is complicated and the cost is high.

SUMMARY AND OBJECT OF THE INVENTION

Accordingly, an object of the present invention is to provide an image forming apparatus in which an image carrier belt is by driven and moved only by a friction force from a driving roller and the image carrier belt can be driven and moved stably.

Those and other objects and advantages are achieved by the present invention which provides an image forming apparatus including an endless image carrier belt configured to be spanned around a driving roller and a driven roller and moved by a friction force provided from an outer circumference surface of the driving roller when the driving roller is rotated, a charging device configured to contact an outer surface of the image carrier belt to charge the image carrier belt; and wherein the outer surface of the image carrier belt which the charging device contacts is a portion of the image carrier belt contacting the driving roller.

BRIEF DESCRIPTION OF THE DRAWINGS

A more complete appreciation of the present invention and many of the attendant advantages thereof will be readily obtained as the same becomes better understood by reference to the following detailed description, particularly when considered in connection with the accompanying drawings, wherein.

DESCRIPTION OF THE PREFERRED EMBODIMENTS

Figure 1:
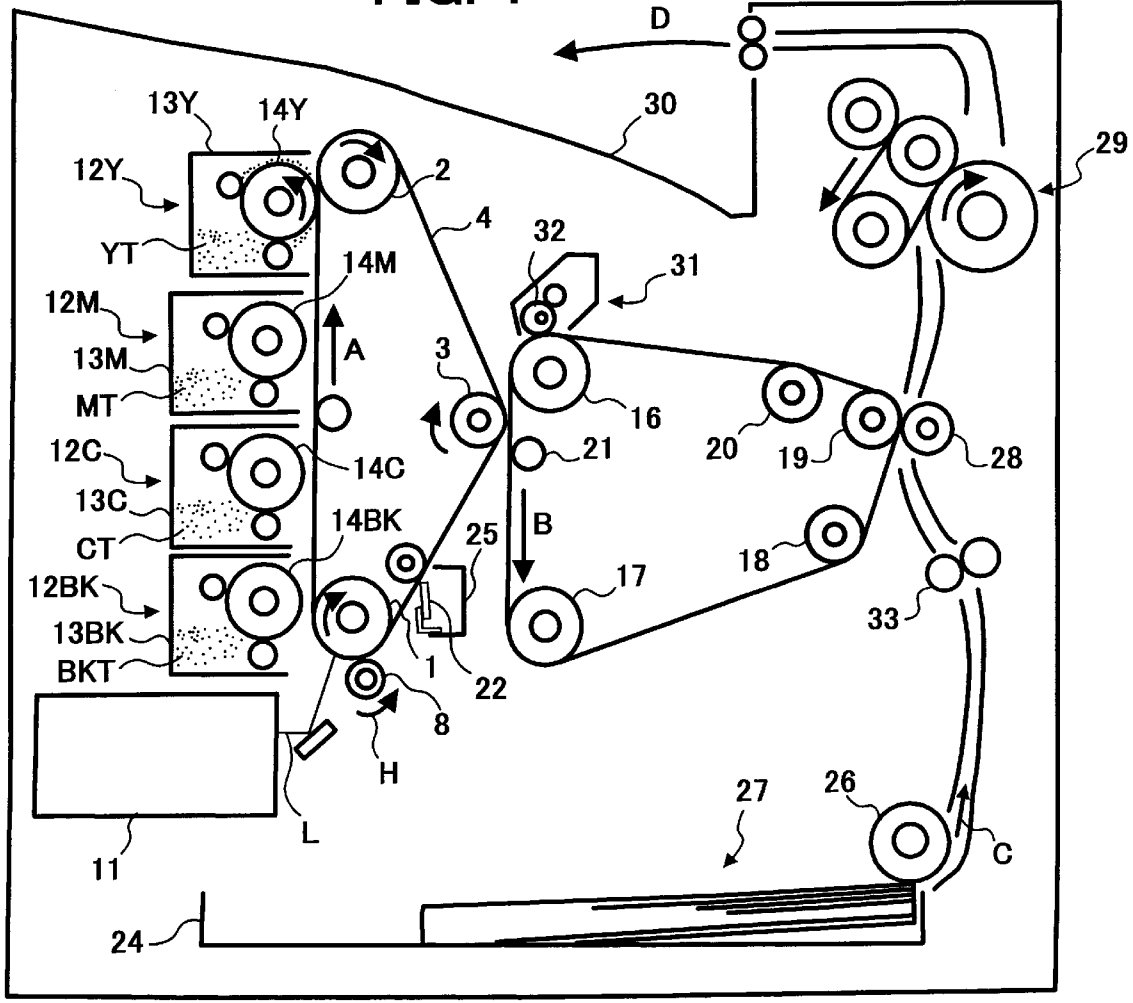
FIG. 1 is a schematic view illustrating an image forming apparatus of the present invention.

Referring now to the drawings, wherein like reference numerals designate identical or corresponding parts throughout the several views, preferred embodiments of the present invention are described.

FIG. 1 is a schematic section view illustrating an embodiment of a color image forming apparatus which forms a full color image. The image forming apparatus has an endless image carrier belt 4 spanned around a driving roller 1 and driven rollers 2 and 3. In the embodiment illustrated in FIG. 1, plural driven rollers are used. However, a single driven roller may instead be used. The image carrier belt 4 is configured as a photoconductive belt in which a photoconductive layer is laminated on a surface of a base.

Figure 2:
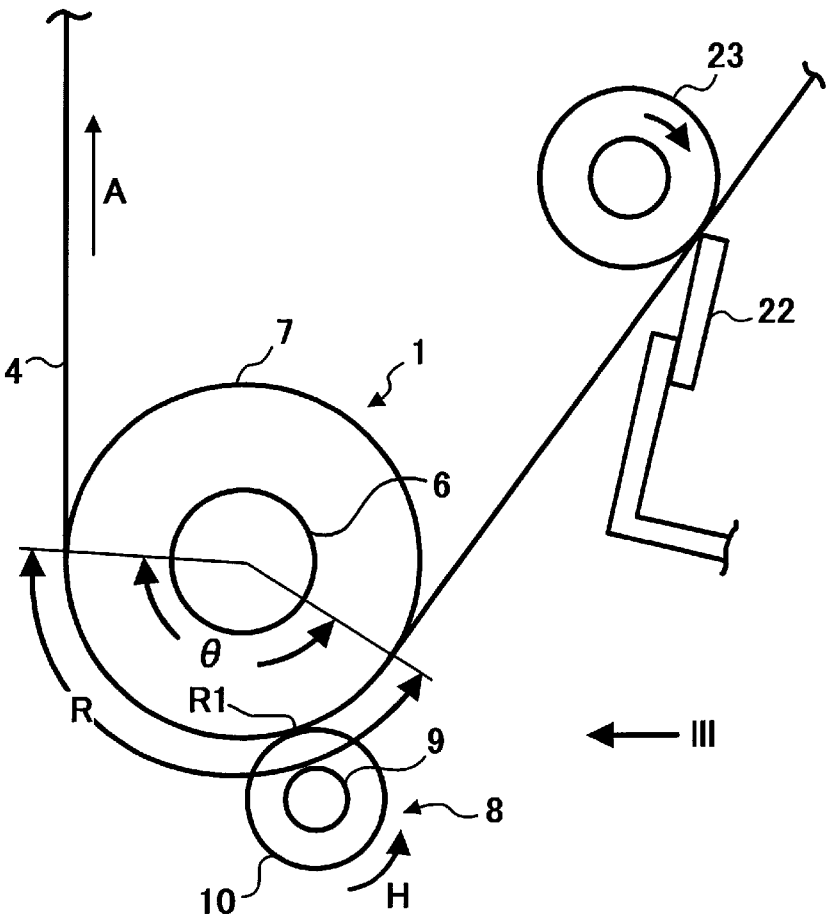
FIG. 2 is an enlarged view illustrating an embodiment of a charging roller and a proximity thereof.
Figure 3:
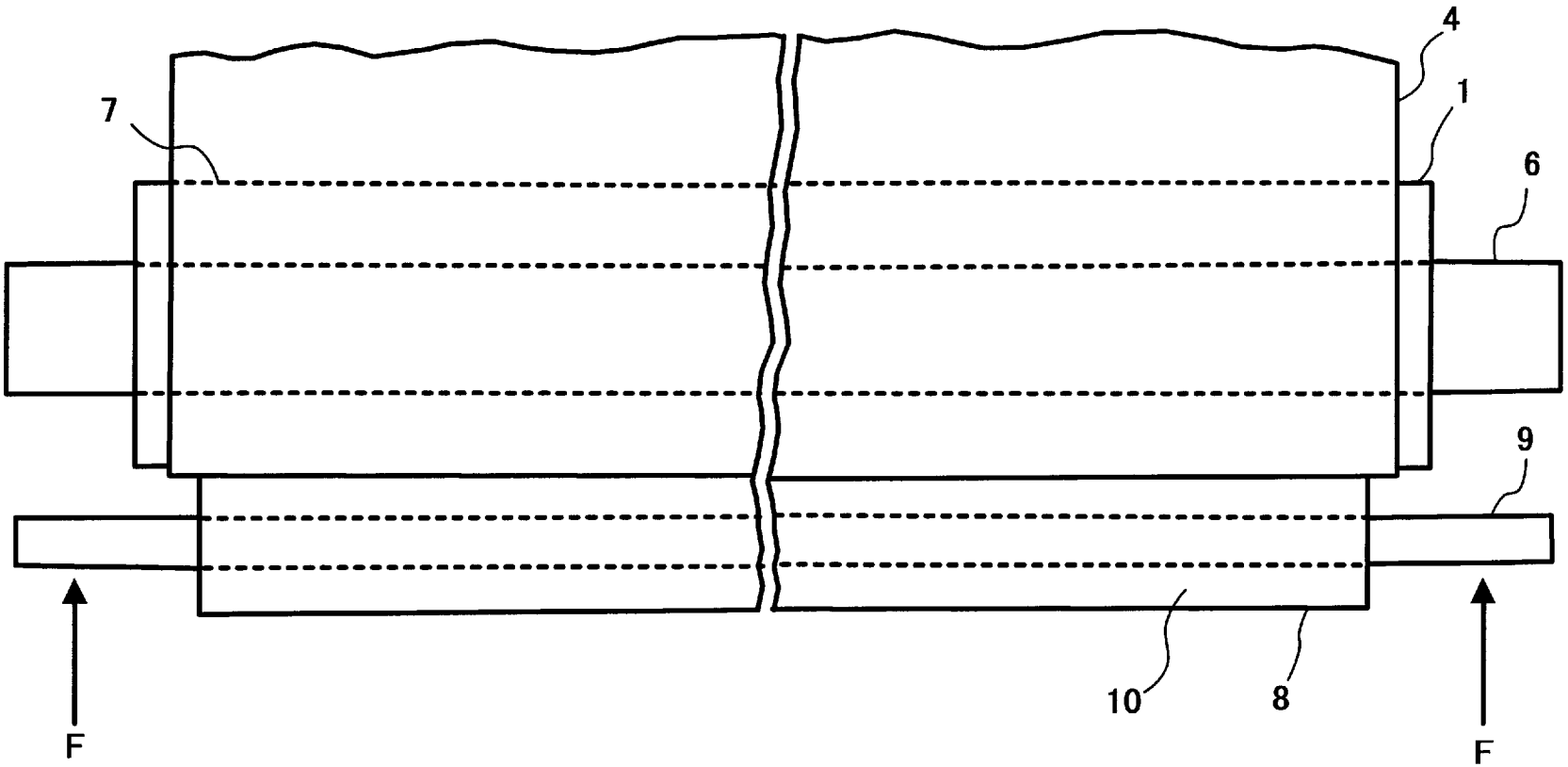
FIG. 3 is a view illustrating an image carrier belt and the charging roller from the viewpoint of a direction indicated by an arrow III in FIG. 2.

The driving roller 1 includes a driving roller shaft 6 of a rigid material such as metal, etc., and a cylindrical driving roller body 7 which is fixed concentrically around an outer circumference surface of the driving roller shaft 6 as illustrated in FIGS. 2 and 3, and the roller body 7 is configured by an elastic material such as rubber, etc. The image carrier belt 4 is spanned around the outer circumference surface of the driving roller body 7 while being pressed and contacted to the surface, and the driving roller shaft 6 is rotatably supported by a frame, not illustrated in FIGS. 2 and 3. The driven rollers 2 and 3 are configured in a similar manner as the driving roller 1. The driving roller 1 is driven and rotated by a motor, not illustrated in FIGS. 2 and 3. The driven rollers 2 and 3 are rotated by the movement of the image carrier belt 4.

The image forming apparatus illustrated in FIG. 1 has a charging roller 8, which is an example of a charging member to charge the surface of the image carrier belt 4 by contacting the outer surface of the image carrier belt 4. The charging roller 8 has a charging roller shaft 9 of a rigid material such as metal, etc., and a cylindrical charging roller body 10 which is fixed concentrically on the outer circumference surface of the charging roller shaft 9. The charging roller body 10 is formed of an elastic material such as a rubber. Each end portion of the charging roller shaft 9 in the shaft direction is rotatably supported by a supporting member such as a frame of the image forming apparatus, and is pressed toward the outer surface of the image carrier belt 4 by a pressing member, not illustrated in FIG. 3, as indicated by an arrow F in FIG. 3, and the outer circumference surface of the charging roller body 10 contacts the outer surface of the image carrier belt 4 over the entire length in the shaft direction.

When an image forming operation starts, the driving roller shaft 6 is driven and rotated by the driving motor described above, and the driving roller 1 is driven and rotated clockwise in FIGS. 1 and 2. By the rotation of the driving roller 1, the endless image carrier belt 4 is driven and moved in a direction indicated by an arrow A (FIGS. 1 and 2) by a friction force from the outer circumference surface of the driving roller 1, which is that of the driving roller body 7 in FIG. 2. The driven rollers 2 and 3 are rotated in unison by movement of the image carrier belt 4.

The charging roller 8 which contacts the outer surface of the image carrier belt 4 is also rotated in a direction indicated by an arrow H (FIGS. 1 and 2), by movement of the outer surface of the image carrier belt 4 or by a driving device, not illustrated in FIGS. 1 and 2. At this time, a charging voltage of a predetermined polarity is applied to the shaft 9 of the charging roller 8, and thereby the outer surface of the image carrier belt 4 is uniformly charged. A laser light L, which is emitted from and modulated in a laser writing unit 11 as an example of an exposing device, is directed onto a charged surface of the image carrier belt 4, and thereby an electrostatic latent image is formed on the outer surface of the image carrier belt 4. In the embodiment illustrated in FIG. 1, a portion of the outer surface of the image carrier belt 4, the absolute value of the surface potential where the laser light L is incident is reduced, and thereby an electrostatic latent image portion, namely an image portion, is formed.

Four developing devices, a yellow developing device 12Y, a magenta developing device 12M, a cyan developing device 12C and a black developing device 12BK, are arranged as facing a portion of the image carrier belt 4 between the driving roller 1 and the driven roller 2. The developing devices 12Y–12BK have developing cases 13Y, 13M, 13C and 13BK storing a yellow toner YT, a magenta toner MT, a cyan toner CT and a black toner BKT respectively, and developing rollers 14Y, 14M, 14C and 14BK which carry and convey respective color toners. In the developing devices in this embodiment, a single component developer of a powder form is used. However, a two components developer of a powder form including a toner and a carrier can be also used. Each of the developing devices 12Y–12BK is configured so as to be located at a developing position close to the outer surface of the image carrier belt 4, or at an escaping position spaced therefrom by a driving device, not illustrated in FIG. 1.

The electrostatic latent image described above is visualized as a toner image by a first developing device located at the developing position, which is the yellow developing device 12Y in this embodiment. At this time, the other developing devices 12M–12BK are located at the escaping positions. The developing roller 14Y of the yellow developing device 12Y faces the outer surface of the image carrier belt 4 contacting the surface, or separated from the surface by a minute gap. The developing roller 14Y is driven and rotated, for example counterclockwise, and a predetermined developing bias is applied to the developing roller 14Y. Thereby, the toner YT carried and conveyed around the developing roller 14Y moves to the electrostatic latent image electrostatically and the latent image is visualized as a yellow toner image.

At the opposite side to the developing devices of the image carrier belt 4 is arranged an intermediate transferring member 15 contacting the outer surface of the image carrier belt 4. In this embodiment, the intermediate transferring member 15 is an endless belt which is spanned around plural rollers 16, 17, 18, 19 and 20, and which is driven and moved in a direction indicated by an arrow B (FIG. 1), however a drum-like intermediate transfer member can instead be used.

The yellow toner image formed on the image carrier belt 4 is electrostatically transferred onto the surface of the intermediate transferring member 15 contacting the image carrier belt 4 by the operation of a transferring voltage which is applied to a first transferring device 21 arranged at a back surface side of the intermediate transferring device 15. Residual toner which adheres to the outer surface of the image carrier belt 4 after transferring the toner image, is scraped and removed by a cleaning member 22 of a cleaning device 25. In this embodiment, a cleaning blade is used as the cleaning member 22. The cleaning member 22 is pressed to a back up roller 23 arranged at an inner side of the image carrier 4, and the cleaning member 22 contacts the outer surface of the image carrier belt 4, and scrapes and removes the residual toner adhering to the outer surface of the image carrier belt 4.

Then, in the same way as described above, a second electrostatic latent image is formed on the outer surface of the image carrier belt 4. The second latent image is visualized as a magenta toner image by the magenta developing device 12M located at the developing position, and the toner image is then transferred onto the intermediate transferring member 15, while being superimposed on the yellow toner image on the surface of the intermediate transferring member 15. Similarly, a cyan toner image and a black toner image are formed on the outer surface of the image carrier belt 4 in sequence by the cyan developing device 12C and the black developing device 12BK, and those toner images are transferred on the surface of the intermediate transferring belt 15, while being superimposed on the previously transferred toner images.

In a lower portion of the image forming apparatus body are arranged a paper feeding device 27 having a paper feeding cassette 24 and a paper feeding roller 26. Recording media P, for example transfer sheets, are piled in the paper feeding cassette 24. The paper feeding roller 26 rotates while contacting an upper surface of an uppermost recording medium P, and thereby the uppermost recording medium P is moved out in a direction indicated by an arrow C in FIG. 1. The moved out recording medium P is conveyed in an upper direction in FIG. 1, and then the recording medium P is conveyed to a transferring portion between the intermediate transferring belt 15 and a second transferring device 28 with a predetermined timing by rotation of a pair of registration rollers 33. At this time, a transferring voltage is applied to the second transferring device 28, and thereby the superimposed toner images on the intermediate transferring belt 15 are transferred all together onto a surface of the recording medium P. The recording medium P on which the toner images are transferred is conveyed from the transferring portion toward a further upper portion of the image forming apparatus body and passes a fixing device 29, where the toner image is fixed on the surface of the recording medium P by an operation of heat and pressure. The recording medium P is then discharged to a discharging portion 30 in an upper surface of the image forming apparatus body, as indicated by an arrow D in FIG. 1.

Residual toner adhering to a surface of the intermediate transferring belt 15 after a toner image is transferred, is removed by a cleaning member 32 of a cleaning device 31. When a toner image on the intermediate transferring belt 15 before transfer of the toner image onto a recording medium P passes the cleaning member 32, the cleaning member 32 is caused to be spaced apart from the surface of the intermediate transferring belt 15, and only when removing residual toner after transfer of the toner image onto a recording medium P does the cleaning member 32 contact the surface of the intermediate transferring belt. Similarly, the second transferring device 28 also contacts the surface of the intermediate transferring belt 15 by sandwiching a recording medium P when transferring a toner image onto the recording medium P. The second transferring device 28 is caused to be spaced apart from the intermediate transferring belt at times other than when transferring a toner image onto a recording medium P, so that a toner image is prevented from being disturbed before transfer onto the intermediate transferring belt 15.

As described above, the image forming apparatus in the above-described embodiment is configured so as to form an electrostatic latent image on the image carrier belt 4 which is charged by a charging member, to visualize the electrostatic latent image as a toner image, and to transfer the toner image onto a recording medium P by way of the intermediate transferring belt 15. However, the image forming apparatus in the embodiment can be configured to include only one developing device and such that a toner image of a single color is formed on the outer surface of the image carrier belt 4 by the developing device, and the toner image is directly transferred onto a recording medium without being transferred onto the intermediate transferring belt.

As illustrated in FIGS. 1–3, the charging member, the charging roller 8 in this embodiment, contacts the outer surface of the portion of the image carrier belt 4 contacting the driving roller 1. The image carrier belt 4 is wound on the outer circumference surface of the driving roller 1 at a winding angle, as illustrated in FIG. 2, and the portion of the image carrier belt 4 within a range of this angle contacts the outer circumference surface of the driving roller 1. Namely, when this portion of the image carrier belt 4 is referred to a contact range R, the outer circumference surface of the charging roller 8 presses and contacts the outer surface of the image carrier belt within the contact range R. Therefore, a portion R1 of the image carrier belt 4 which the charging roller 8 presses and contacts is strongly pressed onto the outer circumference surface of the driving roller 1. Thereby, the friction force between the image carrier belt 4 and the driving roller 1 is increased. Thus, when the driving roller 1 rotates, the slip between the image carrier belt 4 and the driving roller 1 can be effectively prevented, and accordingly an uneven linear speed of the surface of the image carrier belt 4 is prevented, and the image carrier belt 4 can be driven and moved stably.

Conventionally, the charging roller 8 is arranged to contact the image carrier belt 4 at an upstream side of the driving roller 1 in the moving direction of the image carrier belt. In this case, the charging roller 8 tends to brake the image carrier belt 4 and thereby the driving roller 1 slips with respect to the image carrier belt 4, causing unevenness in the surface moving speed of the image carrier belt 4. However, in the image forming apparatus in this embodiment, because the charging roller 8 presses and contacts the portion of the image carrier belt 4 which contacts the driving roller 1, the slip between the image carrier belt 4 and the driving roller 1 is reduced, and therefore unevenness in the moving speed of the image carrier belt 4 is effectively suppressed. Thus, in the image forming apparatus in this embodiment, a complicated and high cost structure in which holes are formed at a side edge portion of the image carrier belt 4 at equal intervals and are engaged with pins provided on a driving roller at equal intervals, so that the image carrier belt is forcibly driven by the pin when the driving roller is rotated, is not adopted, and instead the image carrier belt 4 is driven and moved only by the friction force from the outer circumference surface of the driving roller 1. Nevertheless, the slip between the driving roller 1 and the image carrier belt 4 is effectively suppressed, and thereby unevenness in the surface moving speed of the image carrier belt 4 is suppressed, and accordingly density unevenness or color dislocation in a toner image formed on a recording medium P is prevented from occurring.

Moreover, in general, in order to suppress unevenness in the surface moving speed of the image carrier belt 4 to a minimum, the driving roller 1 is produced with high accuracy so that its straightness is maintained and that the eccentricity thereof is made as small as possible. The charging roller 8 contacts the outer circumference surface of the driving roller 1 thus produced with high accuracy, by way of the image carrier belt 4. Therefore, the charging roller body 10 can contact the outer surface of the image carrier belt 4 over its entire length with a uniform pressure. As a result, the surface of the image carrier belt 4 can be uniformly charged by the charging roller 8, and thereby a high quality toner image having no uneven density portion can be formed on the image carrier belt 4.

Further, as is conventional, when a charging roller contacts the outer surface of a portion of an image carrier belt which is spaced from a driving roller, in order to prevent contact unevenness of the charging roller with respect to the outer surface of the image carrier belt, a back up member is arranged inside the inner surface of the image carrier belt, and the charging roller is pressed against the back up member by way of the image carrier belt, so that the charging member presses and contacts the outer surface of the image carrier belt. In the image forming apparatus in this embodiment, because the driving roller 1 works as a back up member described above, a separate back up member is unnecessary, and thereby the advantage of reducing the cost of an image forming apparatus is obtained.

Next, another embodiment will be described, in which the same portions as those of the embodiment described above will be designated by the same numerals and the description thereof will be omitted.

Figure 4:
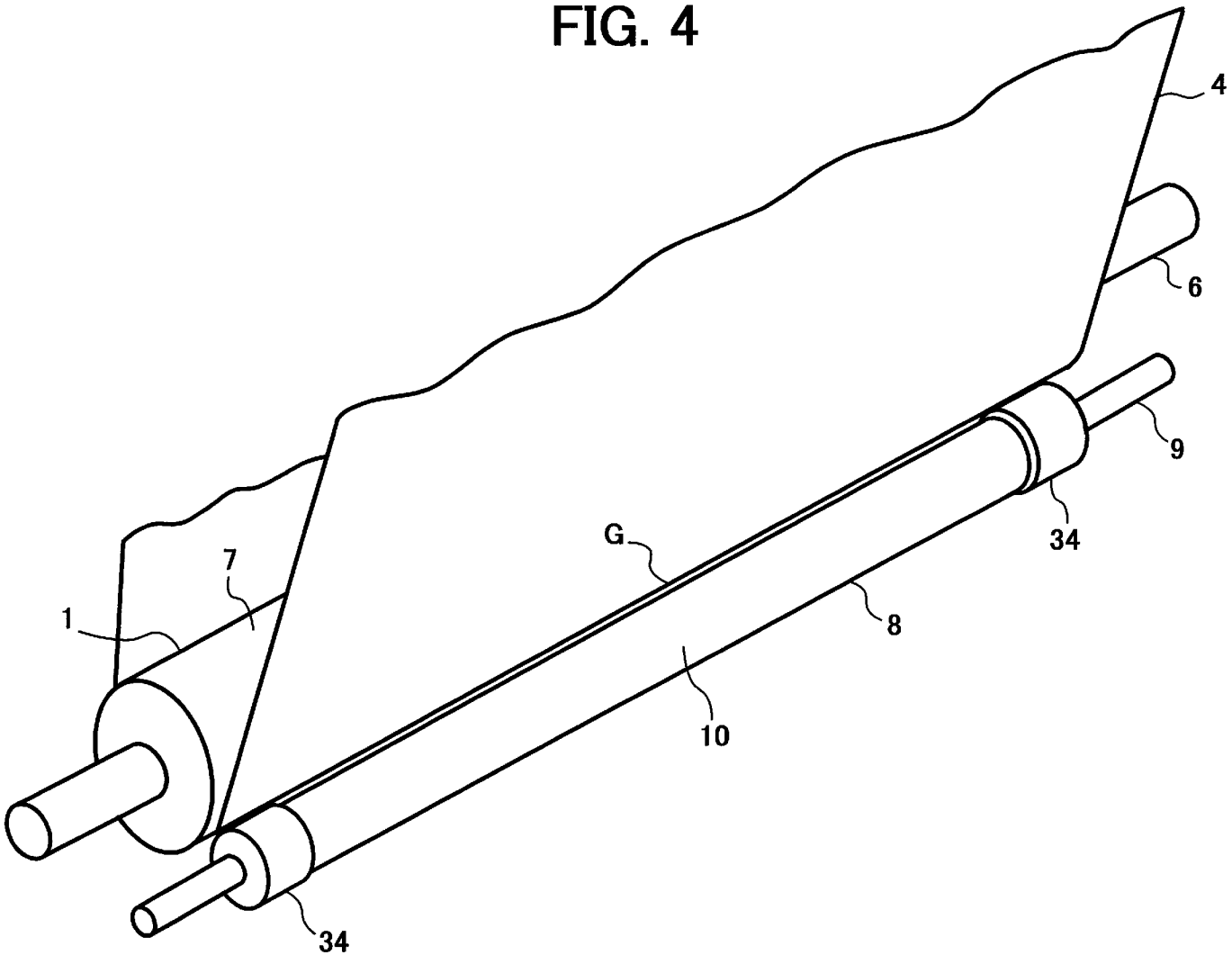
FIG. 4 is a perspective view illustrating another embodiment of the charging roller.

FIG. 4 illustrates the charging roller 8 in the embodiment. The charging roller 8 has a spacer 34 made from a film, a ring or a roller, which is wound around and fixed at end portions of the charging roller body 10 in the shaft direction. The spacer 34 presses and contacts the outer circumference surface of the contact region R (see FIG. 2) of the image carrier belt 4 contacting the image roller 1. Thereby, a minute gap G is formed between the charging roller body 10 and the outer surface of the image carrier belt 4.

By thus structuring the charging roller 8, the same technical advantages as those of the first embodiment can be also obtained. Further, because the spacer 34 contacts the outer circumference surface of the contact region R of the image carrier belt 4 contacting the driving roller 1 produced with high accuracy, the minute gap G described above can be maintained constant and with high accuracy over the entire length of the charging roller 8 in the shaft direction, and thereby the outer surface of the image carrier belt 4 can be uniformly charged. Accordingly a high quality toner image having no uneven density portion can be formed on the image carrier belt 4.

Figure 5:
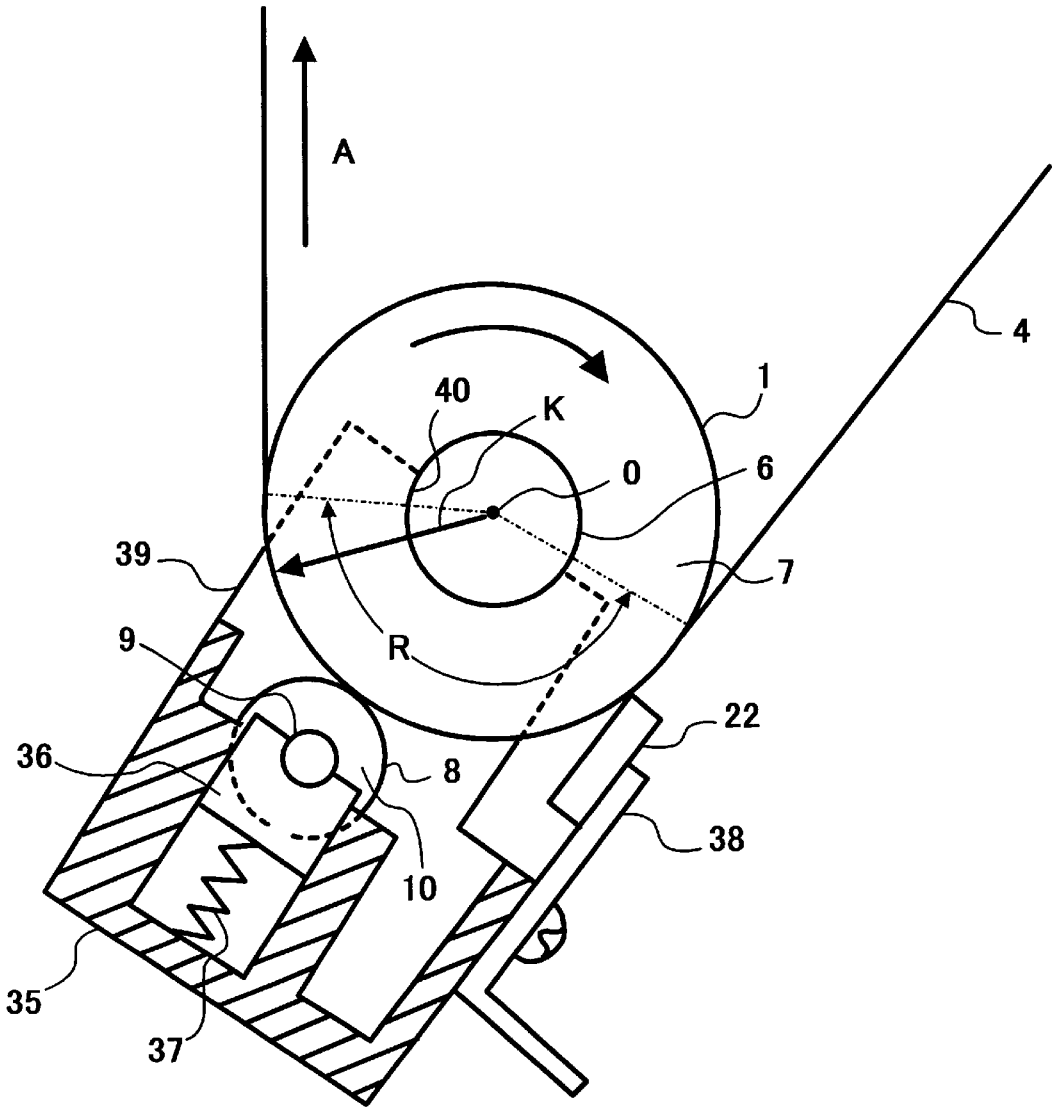
FIG. 5 is a view in similar to FIG. 2, illustrating another embodiment of the charging roller.
Figure 6:
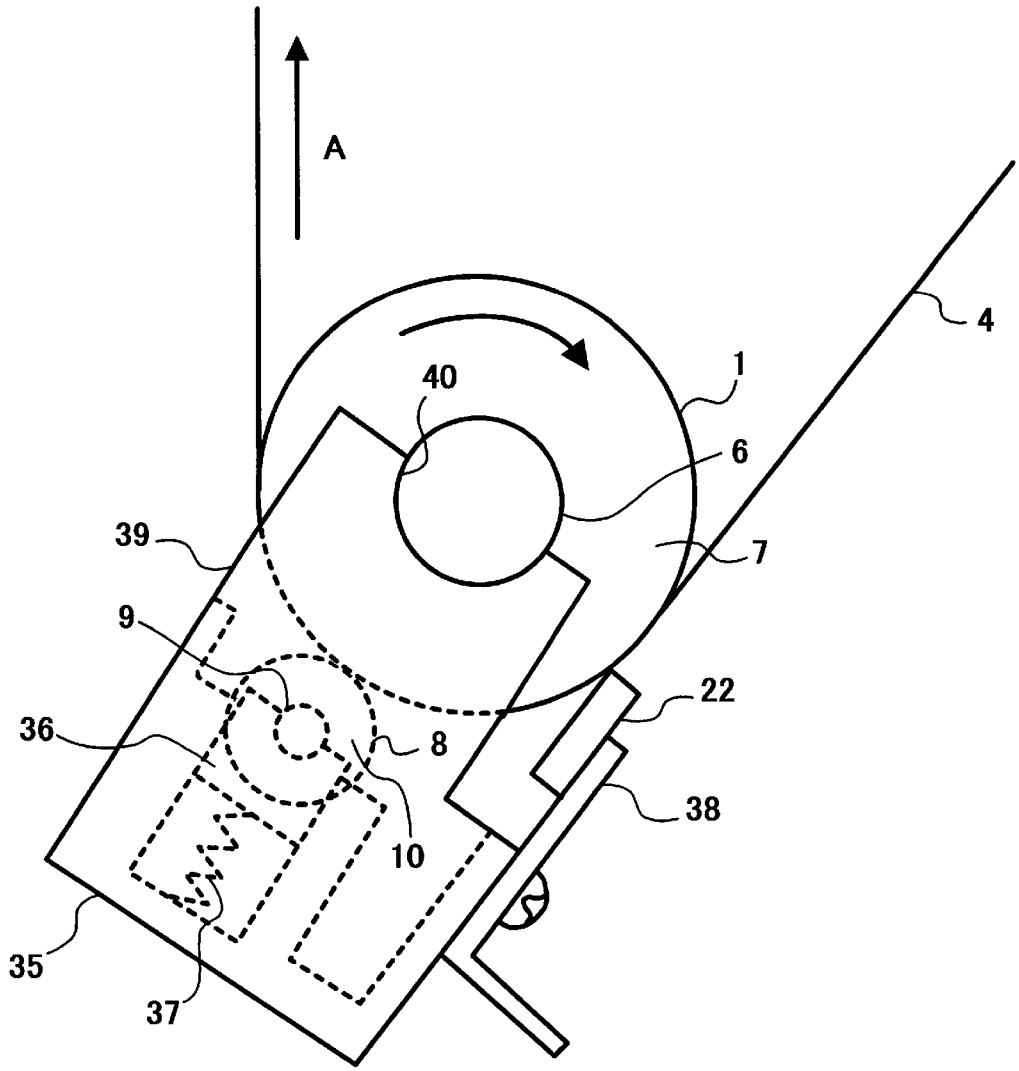
FIG. 6 is a view illustrating a supporting member in FIG. 5 from the viewpoint of its outside.

In a third embodiment illustrated in FIGS. 5 and 6, a cleaning member 22 which scrapes and removes residual toner which adheres to an outer surface of the image carrier belt 4 after a toner image is transferred, also contacts the outer surface of the portion of the image carrier belt, namely that of the contact region R (see FIG. 5). The cleaning member 22 is positioned at a portion of an upstream side of the charging roller 8 in the moving direction of the image carrier belt 4. In the embodiment illustrated in FIGS. 5 and 6, the cleaning member 22 is configured to include a cleaning blade, and a tip edge portion of the cleaning blade presses and contacts the outer surface of the contact region R of the image carrier belt 4. Thus, because both the charging roller 8 and the cleaning member 22 press and contact the outer surface of the contact region R of the image carrier belt 4, the contact pressure between the image carrier belt 4 and the driving roller 1 is further increased. Therefore, when the driving roller 1 rotates, slipping of the driving roller 1 relative to the image carrier belt can be more surely reduced, unevenness in the surface moving speed of the image carrier belt 4 can be more effectively suppressed, and a further higher quality toner image can be obtained.

In the third embodiment illustrated in FIG. 5, the charging roller 8 and the cleaning member 22 are supported by a common supporting member 35. Namely, both end portions of the charging roller shaft 9 in the shaft direction are rotatably supported by bearings 36 (one of the bearings is illustrated in FIG. 5) which are supported by the supporting member 35 so as to be movable toward or away from the image carrier belt 4. Each bearing 36 is pressed toward the outer surface of the image carrier belt 4 by a pressing member 37 made of a compressing spring, and thereby the charging roller body 10 presses and contacts the outer surface of the image carrier belt 4. In this case also, the spacer may be provided on the charging roller body 10 (see FIG. 4), so that the spacer presses and contacts the outer surface of the image carrier 4. Further, a base edge portion of the cleaning member 22 is fixed to a holder 38 which is fixed to a supporting member 35 by for example, a screw. In this way, the charging member 8 and the cleaning member 22 are supported by the common supporting member 35, and therefore, as compared to a case where the charging member 8 and the cleaning member 22 are supported by respective supporting members, the charging member and the cleaning member 32 can be arranged in a respective small space, and thereby the image forming apparatus can be a small size.

Moreover, in this third embodiment, as illustrated in FIGS. 5 and 6, the supporting member 35 is engaged with the driving roller 1. Specifically, the driving roller 1 has a driving roller shaft 6 and a driving roller body 7 fixed to the shaft 6, and the supporting member 35 is engaged with the driving roller shaft 6. In the embodiment illustrated in FIGS. 5 and 6, a bearing groove 40 is formed in each side board 39 of each end portion of the supporting member 35 in a longitudinal direction thereof, and each end portion of the driving roller shaft 6 is relatively rotatably engaged with the bearing groove 40. Thereby, the driving roller shaft 6 becomes a positioning reference of the supporting member 35 and therefore, even if an assembling position of the supporting member 35 is uneven in a circumference direction of the driving roller 1 and the assembling position of the supporting member 35 in the circumference direction is somewhat inaccurate, a length K from a center shaft line O of the driving roller 1 to the outer surface of the image carrier belt 4 is substantially constant in the contact region R of the image carrier belt 4. Therefore, a contacting pressure of the cleaning member 22 on the outer surface of the image carrier belt 4 is not greatly changed. Accordingly, the cleaning member 22 presses and contacts the outer surface of the image carrier belt 4 with a predetermined pressure, and a good cleaning property can be always maintained.

The structure of the third embodiment illustrated in FIGS. 5 and 6 can be also applied to a case where a cleaning member is other than the cleaning blade, for example, a fur brush, etc., contacting the outer surface of the image carrier belt 4.

The winding angle at which the image carrier belt 4 is wound around the driving roller 1 is determined by the arrangement of the driving roller 1 and the driven rollers 2 and 3, etc. In each embodiment described above, the winding angle is set at 180 degrees or less. If the winding angle is small in this way, i.e., 180 degrees or less, in the conventional image forming apparatus described above, the friction force between the driving roller 1 and the image carrier belt 4 becomes small and the slipping can easily occur. However, by the structures described above, even if the winding angle is small, such as 180 degrees or less, slipping between the driving roller 1 and the image carrier belt 4 is effectively suppressed. Thus, when the winding angle is 180 degrees or less, the structures described above can be especially advantageously.

Figure 7:
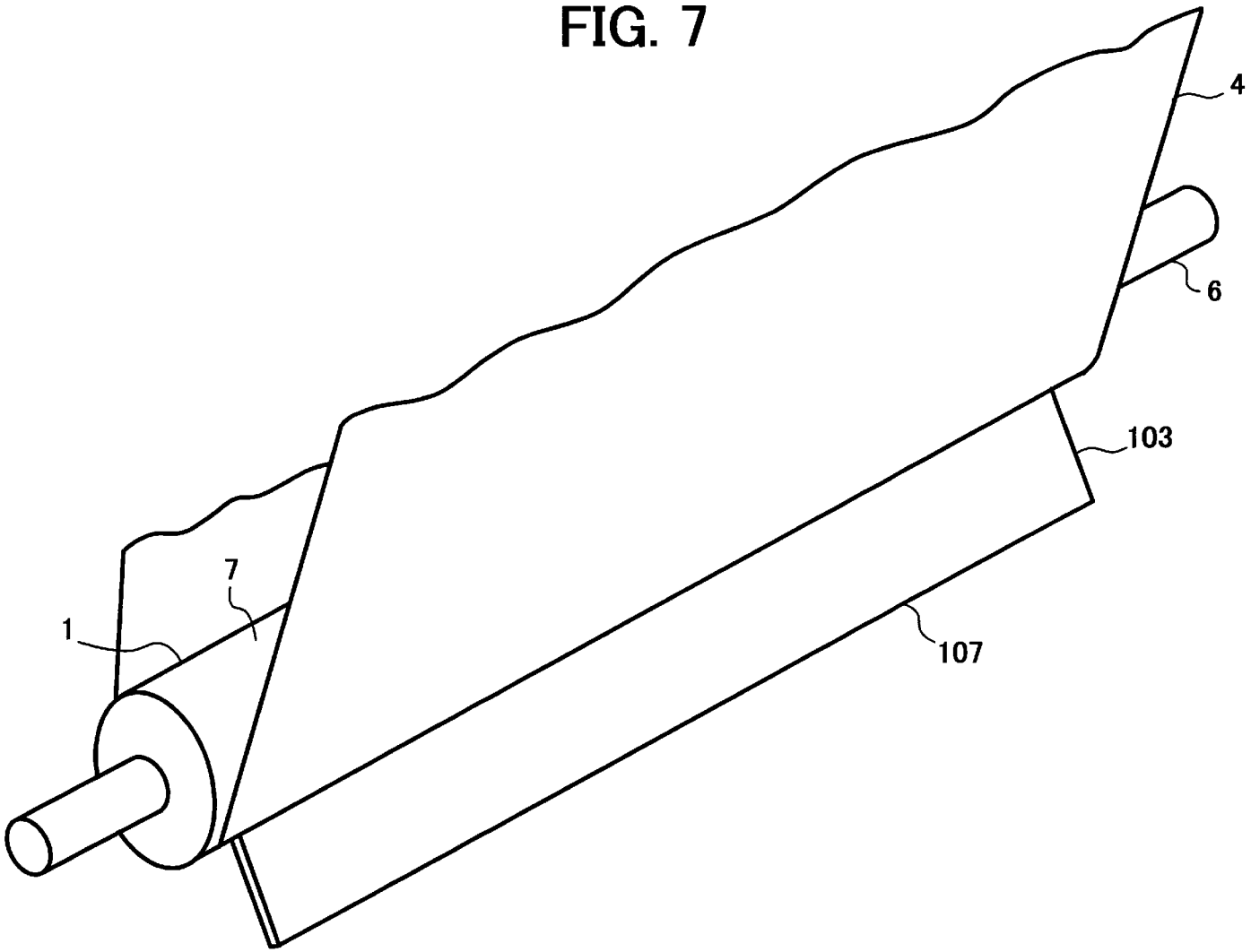
FIG. 7 is a perspective view illustrating an embodiment of a charging member including a charging blade.
Figure 8:
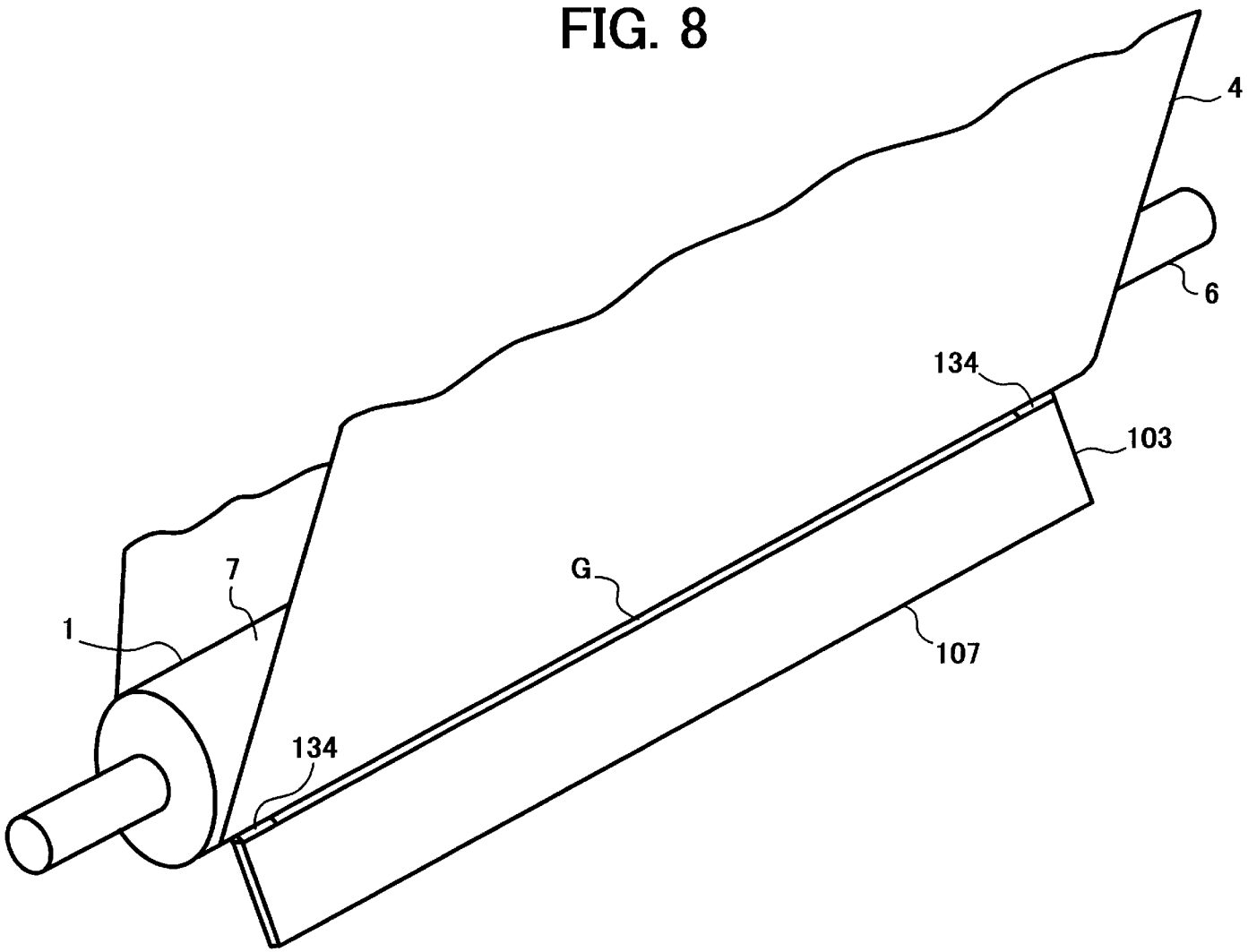
FIG. 8 is a perspective view illustrating another embodiment of the charging member including the charging blade.

In the embodiments described above, the charging roller 8 is used as the charging member. However, even when a charging member other than a charging roller is used, for example a charging blade or a charging brush, contacting the outer surface of the image carrier belt 4, the structures described above can be adopted. FIG. 7 illustrates an embodiment in which a tip of a body 107 of a charging blade 103 contacts the image carrier belt 4, and FIG. 8 illustrates an embodiment in which a spacer 134 which is formed in the body 107 of the charging blade 103 contacts the outer surface of the image carrier belt 4, and a minute gap G is formed between the body 107 and the image carrier belt 4.

In the embodiments illustrated in FIGS. 1–6, the charging roller 8 is used as the charging member, and the charging roller 8 has a charging roller shaft 9, and a charging roller body 10 which is fixed to the charging roller shaft 9, and the charging roller 8 is arranged at a position where it cannot contact the outer surface of the image carrier belt 4 due only its own weight. In the embodiments illustrated in FIGS. 1–6, the driving roller 1 is arranged at a lowermost position among the driving roller 1 and the driven rollers 2 and 3, and the charging roller 8 contacts a portion of the image carrier belt 4 contacting the driving roller 1, namely the contact region R of the image carrier belt 4. Therefore, unless each edge portion of the charging roller shaft 9 is pressed toward the outer surface of the image carrier belt 4 by a pressing member, the charging roller 8 will not contact the outer surface of the image carrier belt 4. In such a case, each end portion of the charging roller 8 in the shaft direction needs to be pressed by a large force which overcomes its own weight. If the charging roller 8 can be arranged so as to contact an upper portion 8 of the image carrier belt 4 in FIG. 1, the weight of the charging roller 8 is applied to the outer surface of the image carrier belt 4, and therefore the force by which a pressing member must press the charging roller 8 against the outer surface of the image carrier belt 4 can be small. However, in the embodiments in FIGS. 1–6, the charging roller shaft 9 must be pressed by a large force with a pressing member.

Figure 9:
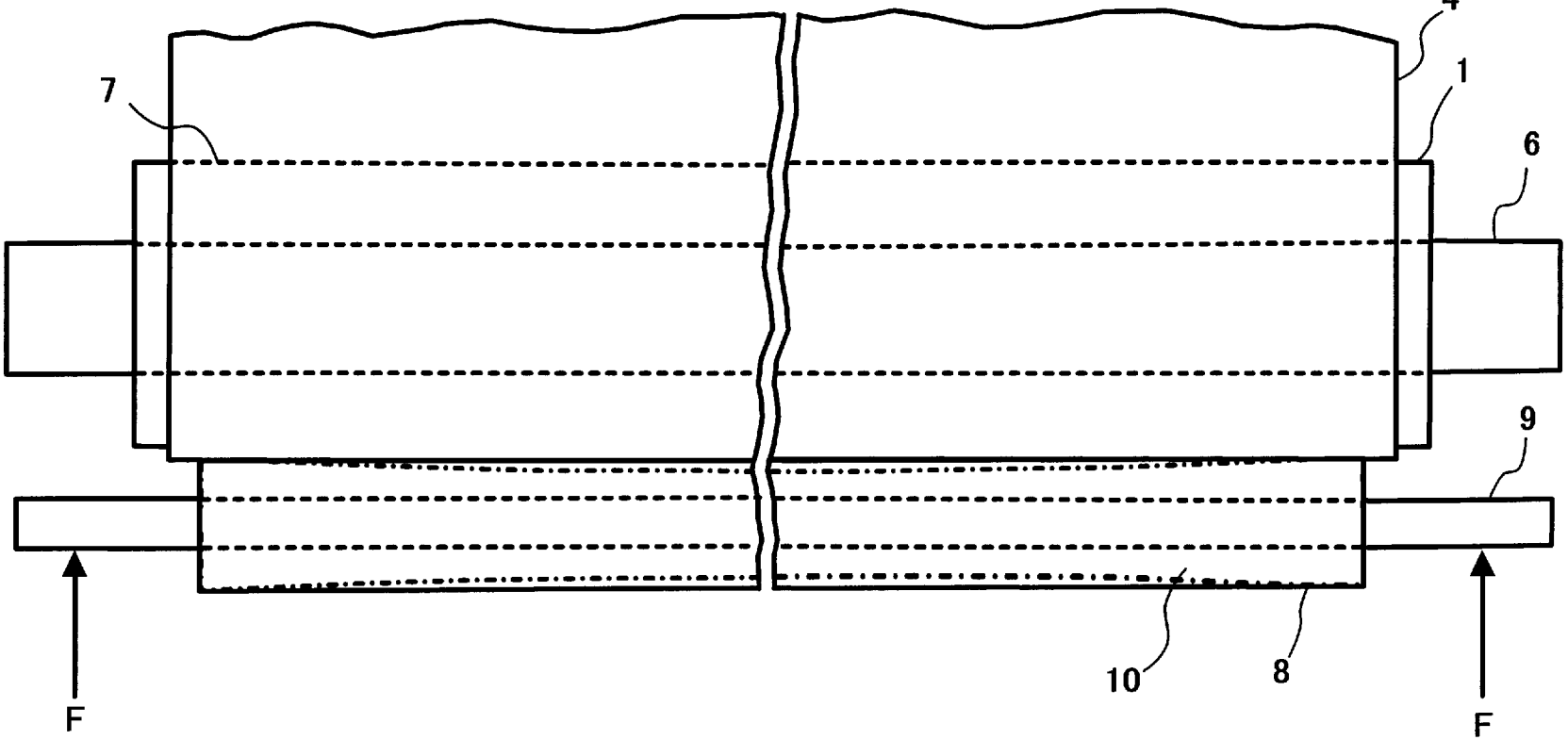
FIG. 9 is a view illustrating change with time of the charging roller when using the charging roller in FIG. 3.

However, if each edge portion of the charging roller shaft 9 in the shaft direction is pressed by a large force, as exaggeratedly illustrated by a dashed line in FIG. 9, the charging roller 8 bends over time such that a center portion of the charging roller body 10 in the shaft direction is farther apart from the outer surface of the image carrier belt 4, and the charging roller body 10 cannot contact the outer surface of the image carrier belt 4 uniformly over the entire length in the shaft direction. Therefore, the image carrier belt 4 cannot be uniformly charged in its width direction, and thereby the quality of a toner image formed on the image carrier belt 4 may be deteriorated. When the charging roller body 10 is separated from the outer surface of the image carrier belt 4 by a minute gap G, as in the embodiment illustrated in FIG. 4, the gap G of the center portion of the charging roller body 10 in the shaft direction is larger than the gap G of each edge portion of the charging roller body 10. Thereby, an abnormal discharge occurs in the center portion of the charging roller body, and the quality of a toner image may be deteriorated.

Figure 10:
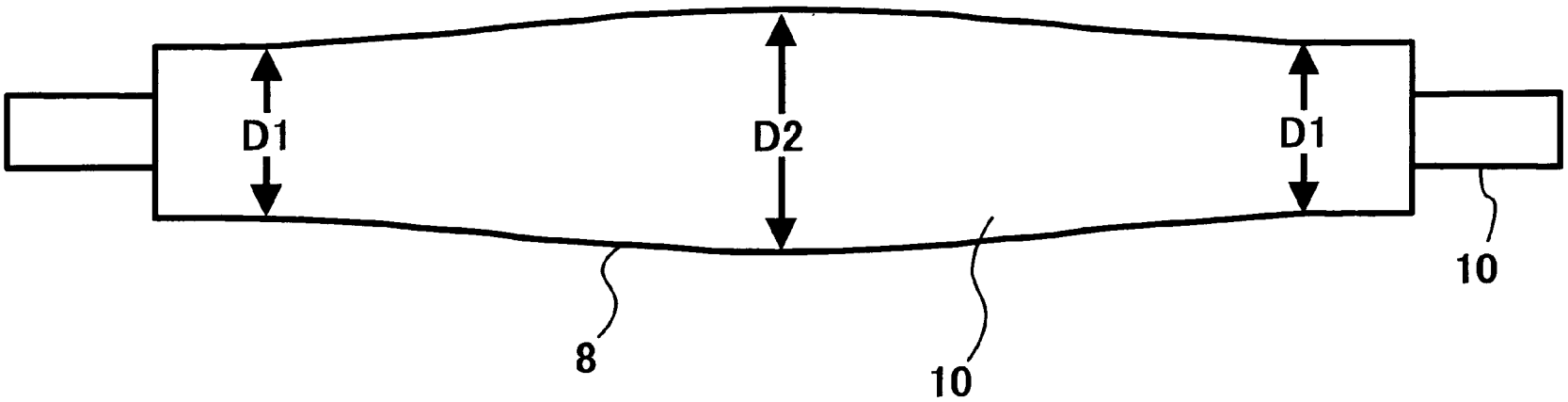
FIG. 10 is a view illustrating another embodiment of the charging roller.

Therefore, in the charging roller body 10 of the charging roller 8 used in the image forming apparatus illustrated in FIGS. 1–6, it is desired that, as illustrated in FIG. 10, the center portion of the charging roller body 10 in the shaft direction is expanded in a radius direction so that an outside diameter D2 of the center portion of the charging roller body 10 is larger than that D1 of each edge portion of the charging roller body 10 in the shaft direction. By such a structure, even if the charging roller 8 bends as indicated by the dashed line in FIG. 9, because the outside diameter D2 of the center portion of the charging roller body 10 is larger than that D1 of each edge portion thereof, the charging roller body 10 can press the outer surface of the image carrier belt 4 uniformly over the entire length of the charging roller body 10 in the shaft direction, or the gap G between the charging roller body 10 and the image carrier belt 4 can be maintained constant. Thereby, the image carrier belt 4 can be uniformly charged and a high quality toner image can be formed on the outer surface of the image carrier belt 4.

Figure 11:
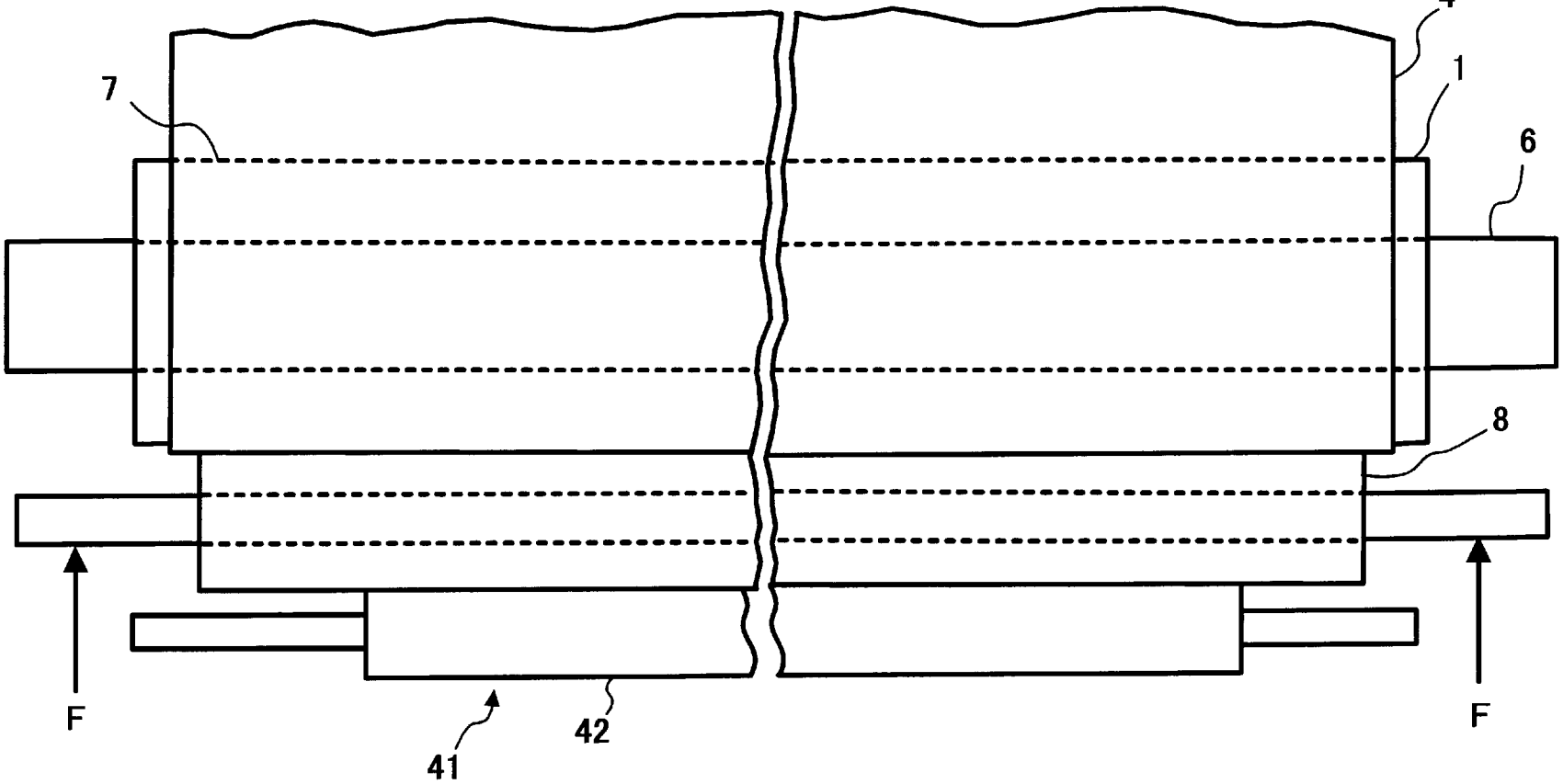
FIG. 11 is a view in similar to FIG. 3, illustrating another embodiment where the charging roller is supported by a supporting roller.

Instead of the structure described above, or in addition to the structure, as illustrated in FIG. 11 a roller supporting member 41 can be arranged in the image forming apparatus illustrated in FIGS. 1–6 so as to support at least the center portion of the charging roller body 10 of the charging roller 8 from below, and to press at least the center portion toward the outer surface of the image carrier belt 4. The roller supporting member 41, illustrated in FIG. 11 as an example, includes a supporting roller 42 which is rotatably supported by a frame of the image forming apparatus, not illustrated in FIG. 11, and the roller 42 contacts at least the center portion of the charging roller body 10 in the shaft direction thereof, and presses the charging roller body 10 from below. In FIG. 11, a case where the charging roller body presses and contacts the outer surface of the image carrier belt 4 is illustrated. However, the roller supporting member 41 can be also adopted in a similar way, in a case illustrated in FIG. 4, in which the spacer 34 contacts the outer surface of the image carrier belt 4 and the charging roller body 10 is positioned so as to be spaced from the outer circumference surface of the image carrier belt 4 by the minute gap G.

By the structure described above also, the charging roller body 10 can be uniformly pressed and contacted to the outer surface of the image carrier belt 4 over the entire length of the charging roller body 10 in the shaft direction, or the minute gap G can be maintained constant, and thereby the image carrier belt 4 can be uniformly charged, so that a high quality toner image can be obtained.

In the image forming apparatus in FIG. 1, the developing devices 12Y, 12M, 12C and 12BK which form toner images of different colors on the outer surface of the image carrier belt 4 in sequence are arranged in one side of the image carrier belt 4 in the horizontal direction, and in the other side of the image carrier belt 4 in the horizontal direction is arranged the intermediate transferring member 15 on which the toner images are transferred in sequence from the image carrier belt so as to be superimposed with each other, and the recording medium P on which the superimposed toner images on the intermediate transferring member 15 are transferred all together is conveyed from a lower region of the image forming apparatus to a transferring portion, and is then conveyed from the transferring portion to an upper region of the image forming apparatus, and the driving roller 1 is positioned at the lowermost position among the driving roller 1 and the driven rollers 2 and 3 around which the image carrier belt 4 is spanned. However, the present invention can also apply to other types of image forming apparatuses than the image forming apparatus described above. Further, the present invention can also apply to an image forming apparatus in which a toner image of a single color formed on an image carrier belt is transferred onto a recording medium.

As described, according to one aspect of the present invention, because the slip of an image carrier belt relative to a driving roller can be suppressed, unevenness in the surface moving speed of the image carrier belt can be suppressed, and thereby a high quality toner image can be obtained.

Further, according to another aspect of the present invention, a cleaning member also contacts the outer surface of a portion of the image carrier belt contacting the driving roller. Thereby, the slip of the image carrier belt relative to the driving roller can be suppressed in a more effective manner.

Furthermore, according to another aspect of the present invention, the image forming apparatus can be of a small size.

Still further, according to another aspect of the present invention, the contacting pressure of the cleaning member to the image carrier belt can be prevented from being greatly changed, and thereby a good cleaning property relative to the image carrier belt can be maintained.

Still furthermore, according to another aspect of the present invention, because the contacting pressure of the charging roller body to the outer surface of the image carrier belt can be uniform, or a minute gap between the charging roller body and the outer surface of the image carrier belt can be maintained constant, a high quality toner image can be formed.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications Nos. 2000-066136 filed on Mar. 10, 2000 and 2001-034667 filed on Feb. 9, 2001 in the Japanese Patent Office, and the entire contents of which are hereby incorporated by reference.

What is claimed as new and is desired to be secured by Letters Patent of the United States is:

1. An image forming apparatus comprising:

an endless image carrier belt spanned around a driving roller and a driven roller such that the image carrier belt is moved by a friction force provided from an outer circumference surface of the driving roller when the driving roller is rotated;

a charging device contacting an outer surface of the image carrier belt so as to charge the image carrier belt, wherein the outer surface of the image carrier belt which the charging device contacts is also a portion of the image carrier belt spanned around the driving roller; and an exposing device configured and adapted to expose the image carrier belt charged by the charging device, and to form an electrostatic latent image on the image carrier belt.

2. The image forming apparatus of claim 1, further comprising:

a developing device configured and adapted to visualize the electrostatic latent image as a toner image;

a transferring device configured and adapted to transfer the toner image onto a recording medium; and a cleaning device configured and adapted to remove a residual toner adhering to the outer surface of the image carrier belt after the toner image is transferred;

wherein the cleaning device contacts the outer surface of another portion of the image carrier belt other than that spanned around the driving roller.

3. The image forming apparatus of claim 1, further comprising:

a developing device configured and adapted to visualize the electrostatic latent image as a toner image;

a transferring device configured and adapted to transfer the toner image onto a recording medium via an intermediate transferring member;

a cleaning device configured and adapted to remove a residual toner adhering to the outer surface of the image carrier belt after the toner image is transferred; and wherein the cleaning device contacts the outer surface of another portion of the image carrier belt, other than that spanned around the driving roller.

4. The image forming apparatus of claim 2, wherein the charging device and the cleaning device are supported by a common supporting member.

5. The image forming apparatus of claim 4, wherein the supporting member is positioned by being engaged with the driving roller.

6. The image forming apparatus of claim 5, wherein the driving roller includes a shaft and a driving roller body fixed to the shaft, and the supporting member is engaged with the shaft of the driving roller.

7. The image forming apparatus of claim 1, wherein a winding angle at which the image carrier belt is spanned around the driving roller is set to 180 degrees or less.

8. The image forming apparatus of claim 1, wherein the charging device comprises a charging roller including a shaft and a charging roller body fixed to the shaft, and the charging roller is arranged at a position where the charging roller does not contact the outer surface of the image carrier belt due to the weight of the charging roller itself, and each of end portions of the charging roller in a shaft direction is pressed toward the outer surface of the image carrier belt, and a center portion of the charging roller body in the shaft direction is radially expanded so that an outside diameter of the center portion of the charging roller is larger than that of the end portions of the charging roller in the shaft direction.

9. The image forming apparatus of claim 1, wherein the charging device comprises a charging roller including a shaft and a charging roller body fixed to the shaft, and the charging roller is arranged at a position where the charging roller does not contact the outer surface of the image carrier belt due to the weight of the charging roller itself, and each of end portions of the charging roller in a shaft direction is pressed toward the outer surface of the image carrier belt, and the image forming apparatus further comprises a roller supporting device configured to support at least a center portion in a shaft direction of the charging roller body and to press the center portion toward the outer surface of the image carrier belt.

10. The image forming apparatus of claim 1, further comprising a plurality of developing devices configured to form toner images of different colors in sequence onto the outer surface of the image carrier belt, the plurality of developing devices being arranged at one side of the image carrier belt in a horizontal direction, and further comprising an intermediate transferring member onto which the toner images are transferred from the image carrier belt in sequence superimposing one upon another, the intermediate transferring member being arranged at another side of the image carrier belt in the horizontal direction, and further comprising a transferring device configured to transfer the toner images onto a recording medium, the transferring device being arranged in a middle region of the apparatus, and wherein the recording medium onto which superimposed toner images on the intermediate transferring member are transferred is conveyed toward the transferring device from a lower region of the apparatus and is conveyed toward an upper region of the apparatus from the transferring device, and wherein the driving roller is positioned at a lower position than the driven roller.

11. An image forming apparatus comprising:

an image carrier belt;

means for moving the image carrier belt and a driven roller by a friction force between the image carrier belt and the image carrier belt moving means; and charging means for charging the image carrier belt by contacting an outer surface of the image carrier belt, wherein the image carrier belt contacts the image carrier belt moving means such that the outer surface of the image carrier belt which the charging means contacts is also a portion of the image carrier belt contacting the image carrier belt moving means, and an exposing device configured and adapted to expose the image carrier belt charged by the charging means, and to form an electrostatic latent image on the image carrier belt.

12. An image forming method comprising the steps of:

rotating a driving roller around which an image carrier belt is spanned so as to move the image carrier belt by a friction force between the image carrier belt and the driving roller so as to move a driven roller; and charging the image carrier belt with a charging device contacting an outer surface of the image carrier belt, wherein the outer surface of the image carrier belt which the charging device contacts is also a portion of the image carrier belt spanning the driving roller, and an exposing device configured and adapted to expose the image carrier belt charged by the charging device, and to form an electrostatic latent image on the image carrier belt.

* * * * *